US010884354B2

(12) United States Patent
Uchimitsu et al.

(10) Patent No.: US 10,884,354 B2
(45) Date of Patent: Jan. 5, 2021

(54) DEVELOPER SUPPLY DEVICE AND IMAGE FORMING APPARATUS

(71) Applicant: FUJI XEROX CO., LTD., Tokyo (JP)

(72) Inventors: Daisuke Uchimitsu, Kanagawa (JP); Makoto Kanno, Kanagawa (JP); Katsumi Yamada, Kanagawa (JP); Yoshihisa Nakao, Kanagawa (JP); Ryo Fukuno, Kanagawa (JP); Tomoyuki Hamachi, Kanagawa (JP)

(73) Assignee: FUJI XEROX CO., LTD., Tokyo ( * ) Notice: Subject to any disclaimer, the term of this patent is extended or adjusted under 35 U.S.C. 154(b) by 0 days.

(21) Appl. No.: 16/658,369

(22) Filed: Oct. 21, 2019

(65) Prior Publication Data

US 2020/0310292 A1 Oct. 1, 2020

(30) Foreign Application Priority Data

Apr. 1, 2019 (JP) ..... 2019-069928

(51) Int. Cl.
*G03G 15/08* (2006.01)

(52) U.S. Cl.
CPC ..... *G03G 15/0868* (2013.01); *G03G 15/0849* (2013.01); *G03G 15/0872* (2013.01); *G03G 15/0877* (2013.01); *G03G 15/0891* (2013.01); *G03G 2215/0668* (2013.01)

(58) Field of Classification Search
CPC ..... G03G 15/0868; G03G 15/0849; G03G 15/0872; G03G 15/0877; G03G 15/0891; G03G 2215/0668
See application file for complete search history.

(56) References Cited

U.S. PATENT DOCUMENTS

| | | | | |
|---|---|---|---|---|
| 5,589,919 | A | 12/1996 | Ikunami et al. | |
| 6,256,469 | B1 | 7/2001 | Taniyama et al. | |
| 2017/0090349 | A1* | 3/2017 | Noguchi | G03G 15/0891 |

FOREIGN PATENT DOCUMENTS

| | | | |
|---|---|---|---|
| JP | 3353175 | B2 | 12/2002 |
| JP | 3480827 | B2 | 12/2003 |
| JP | 2016-164585 | A | 9/2016 |

* cited by examiner

*Primary Examiner* — Hoang X Ngo
(74) *Attorney, Agent, or Firm* — Sughrue Mion, PLLC

(57) ABSTRACT

A developer supply device includes a developer container, an adjustment mechanism, and a controller. The developer container is configured to supply developer by rotating. The adjustment mechanism is configured to adjust a rotation angle of the developer container. The controller is configured to control the rotation angle of the developer container by the adjustment mechanism according to a developer remaining amount in the developer container.

16 Claims, 11 Drawing Sheets

DEVELOPER SUPPLY DEVICE AND IMAGE FORMING APPARATUS

CROSS-REFERENCE TO RELATED APPLICATIONS

This application is based on and claims priority under 35 USC 119 from Japanese Patent Application No. 2019-069928 filed Apr. 1, 2019.

BACKGROUND

(i) Technical Field

The present disclosure relates to a developer supply device and an image forming apparatus.

(ii) Related Art

JP-B-3480827 discloses a toner replenishing device and a toner cartridge used therefor. The toner replenishing device supplies toner while rotating a replaceable cylindrical toner cartridge. The toner replenishing device breaks up locally accumulated toner in the toner cartridge by rotating the toner cartridge in forward and reverse directions by a predetermined angle in response to replacement of the toner cartridge or a desired situation.

JP-B-3353175 discloses a toner cartridge including a cylindrical toner storage container. The toner storage container has an opening for discharging a stored toner, at an end surface thereof, and a spiral protrusion on an inner peripheral surface thereof. The toner cartridge is installed substantially horizontally in an image forming apparatus and transports the stored toner by rotation of the container and discharges the toner from the opening. An inclined surface for discharging the stored toner by rotation of the container is provided in the opening. A scoop portion is provided integrally with the rotation container. An outer part of the scoop portion in a rotation radial direction on the inclined surface is joined to the inner peripheral surface of the toner cartridge. Rotating of the toner cartridge allows discharging of the toner above the central axis of rotation.

JP-A-2016-164585 discloses an image forming apparatus that forms an image on a sheet using toner. The image forming apparatus includes a toner container storage portion provided in an apparatus main body, a toner container removably housed in the toner container storage portion, a toner remaining amount acquisition unit for acquiring a toner remaining amount in the toner container, and a movable lever that is visible from the outside of the apparatus main body and that is displaced according to the toner remaining amount acquired by the toner remaining amount acquisition unit. The position of the movable lever shows the toner remaining amount in the toner container.

SUMMARY

In a developer supply device that supplies developer while rotating a developer container containing the developer, when the developer remaining amount in the developer container decreases, the developer adheres to and remains on a wall surface of the developer container, and the developer remaining in the developer container may not be used efficiently.

Aspects of non-limiting embodiments of the present disclosure relate to a developer supply device and an image forming apparatus capable of preventing a decrease in developer supply amount per unit time when the developer remaining amount in the developer container decreases in the developer supply device that rotates the developer container to supply the developer.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developer supply device including: a developer container configured to supply developer by rotating; an adjustment mechanism configured to adjust a rotation angle of the developer container; and a controller configured to control the rotation angle of the developer container by the adjustment mechanism according to a developer remaining amount in the developer container.

BRIEF DESCRIPTION OF THE DRAWINGS

Exemplary embodiment(s) of the present disclosure will be described in detail based on the following figures, wherein.

DETAILED DESCRIPTION

Figure 1:
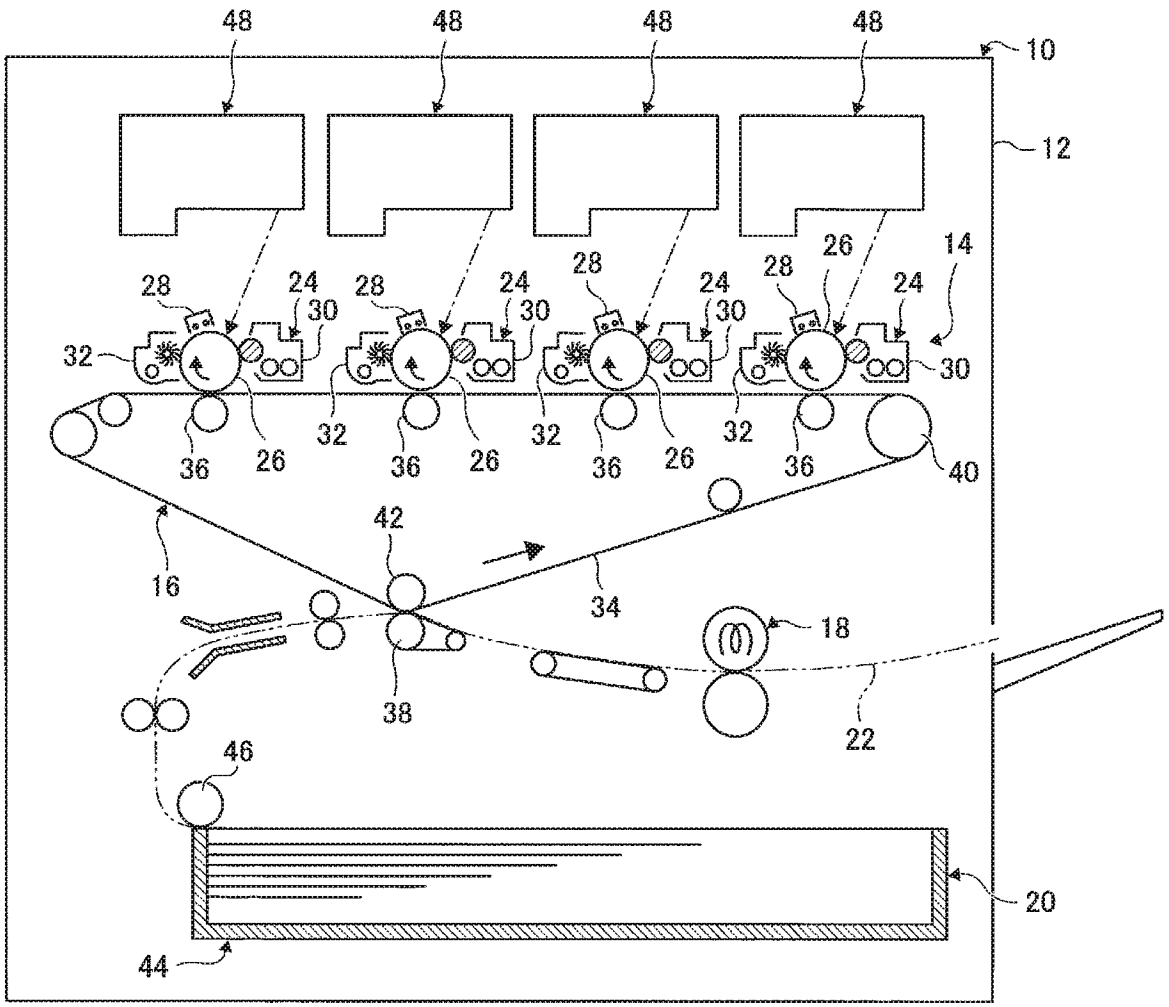
FIG. 1 is a side view showing a configuration of an image forming apparatus according to an exemplary embodiment of the present disclosure.

Next, exemplary embodiments of the present disclosure will be described with reference to the drawings. FIG. 1 shows an image forming apparatus 10 used in an exemplary embodiment of the present disclosure. The image forming apparatus 10 includes an image forming apparatus main body 12. An image forming device 14, a transfer device 16, a fixing device 18, and a sheet feeding device 20 are disposed in the image forming apparatus main body 12. Further, a transport path 22 for transporting a recording medium such as a sheet is formed in the image forming apparatus main body 12.

The image forming device 14 adopts an electrophotographic process and forms an image on the recording medium. The image forming device 14 includes plural image forming units 24, for example, four image forming units 24. The four image forming units 24 form toner images of different colors such as yellow, magenta, cyan, and black.

The image forming unit 24 includes a photoconductor drum 26. The photoconductor drum 26 is an example of an image carrier and rotates while carrying a toner image to be transferred to the recording medium on an outer peripheral surface thereof. Further, the image forming unit 24 includes a charging device 28 that charges the photoconductor drum 26, a developing device 30 that develops a charged latent image with toner, and a cleaning device 32 that cleans the photoconductor drum 26 after transfer. An optical writing device 48 that forms the latent image on the charged photoconductor drum 26 is provided.

The transfer device 16 includes an intermediate transfer belt 34. Each toner image is primarily transferred from a respective one of the photoconductor drums 26 to the intermediate transfer belt 34 by the primary transfer member 36. The primarily transferred toner image is secondarily transferred to the recording medium by the secondary transfer member 38.

The intermediate transfer belt 34 is supported by plural support members 40 so as to be rotatable. A backup member 42 faces a secondary transfer member 38.

The fixing device 18 fixes the toner image, which is transferred onto the recording medium, to the recording medium using, for example, heat and pressure.

The sheet feeding device 20 includes an accommodation unit 44 that accommodates recording media in a stacked state, and a delivery member 46 that delivers the recording medium accommodated in the accommodation unit 44 toward the transport path 22.

The transport path 22 transports the recording medium from the sheet feeding device 20 to a position between the secondary transfer member 38 and the backup member 42, further transports the recording medium to the fixing device 18, and still further transports the recording medium so as to discharge the recording medium to the outside of the image forming apparatus main body 12.

In the image forming apparatus 10 configured as described above, the toner image formed on the outer peripheral surface of the photoconductor drum 26 is primarily transferred onto the intermediate transfer belt 34. The toner image primarily transferred onto the intermediate transfer belt 34 is secondarily transferred onto the recording medium. The toner image secondarily transferred onto the recording medium is fixed on the recording medium by the fixing device 18.

Figure 2:
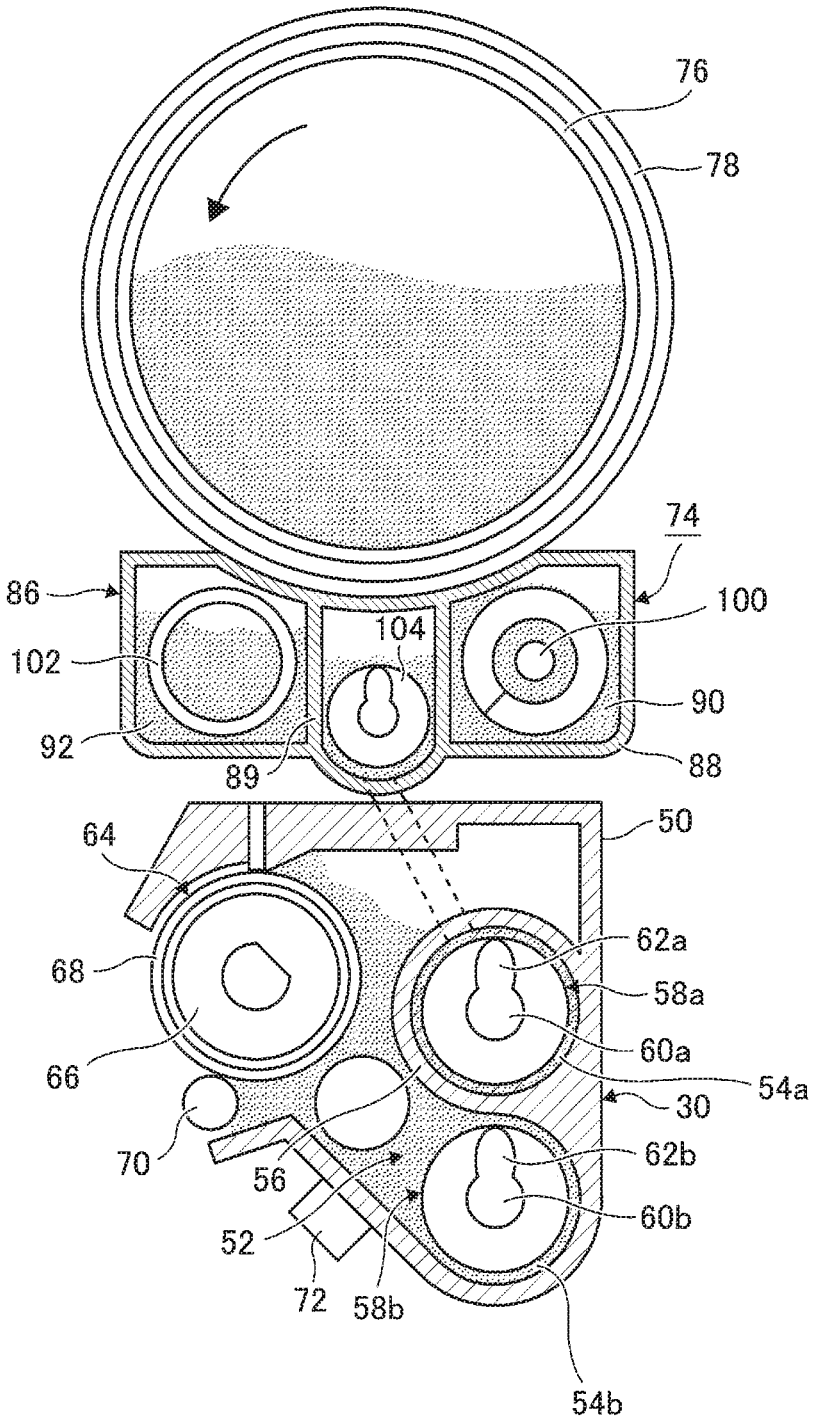
FIG. 2 is a cross-sectional view showing a developer supply system used in the image forming apparatus according to the exemplary embodiment of the present disclosure.

FIG. 2 shows a developer supply system.

The developing device 30 is a two-component developing device that agitates the developer including a carrier and a toner to charge and develop the toner.

The developing device 30 includes a developing device main body 50. A developer transport unit 52 is provided in the developing device main body 50. For example, two agitation transport paths 54*a* and 54*b* are formed in the developer transport unit 52 and extend in the longitudinal direction of the developing device main body 50. The agitation transport paths 54*a* and 54*b* are partitioned in the longitudinal direction by a partition wall 56, and are connected to each other at both ends in the longitudinal direction of the agitation transport paths 54*a* and 54*b*. Agitation transport members 58*a* and 58*b* are disposed in the agitation transport paths 54*a* and 54*b*. The agitation transport members 58*a* and 58*b* respectively include rotation shafts 60*a* and 60*b*, and agitation transport units 62*a* and 62*b* spirally formed around the rotation shafts 60*a* and 60*b*. The developer transport unit 52 agitates and transports the developer by the rotating agitation transport members 58*a* and 58*b* to charge the carrier and the toner.

Further, a developing roller 64 is provided in the developing device main body 50. The developing roller 64 includes a magnet portion 66 that is fixed inside and forms a magnetic pole on a circumferential surface thereof, and a sleeve 68 that rotates around the magnet portion 66. The developing roller 64 faces the photoconductor drum 26. The developing roller 64 is configured such that the toner adhering to a magnetic brush formed around the sleeve 68 is moved to the latent image formed on the image carrier 34. A layer thickness regulating member 70 is provided in the developing device main body 50 and faces the developing roller 64. The layer thickness regulating member 70 regulates the layer thickness of the magnetic brush formed on the sleeve 68. The tip of the magnetic brush formed on the sleeve 68 comes into contact with the photoconductor drum 26, and the latent image on the photoconductor drum 26 is developed with the toner.

A magnetic permeability sensor 72 is provided in the developing device main body 50. The magnetic permeability sensor 72 measures the magnetic permeability of the carrier existing around the magnetic permeability sensor 72. When the magnetic permeability sensor 72 detects that the amount of carrier is large, the amount of developer is short. Therefore, the developer is controlled to be supplied from a developer container 76 which will be described later.

Figure 3:
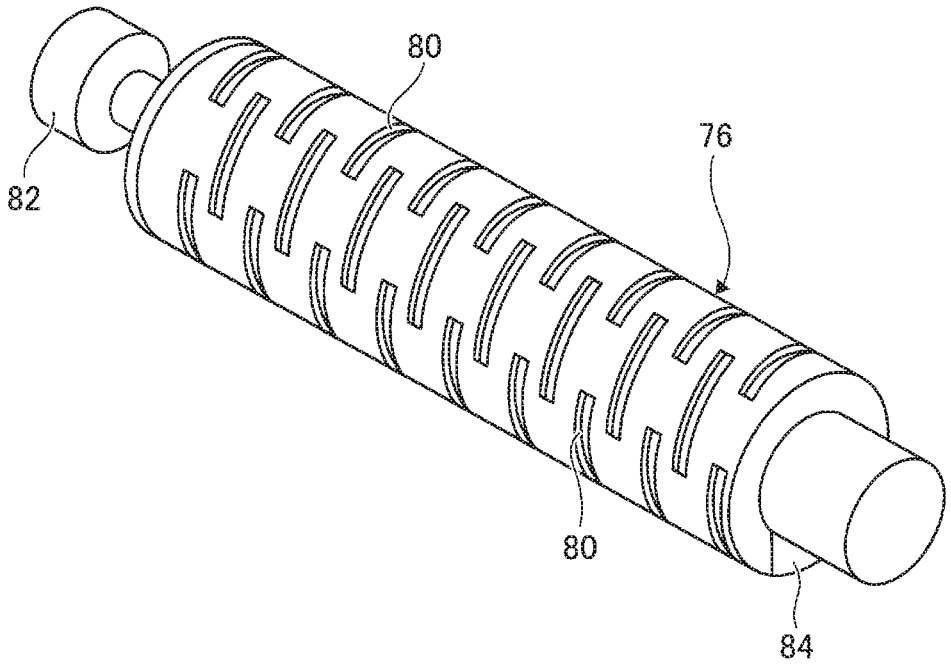
FIG. 3 is a perspective view showing a developer container used in the developer supply device according to the exemplary embodiment of the present disclosure.
Figure 4:
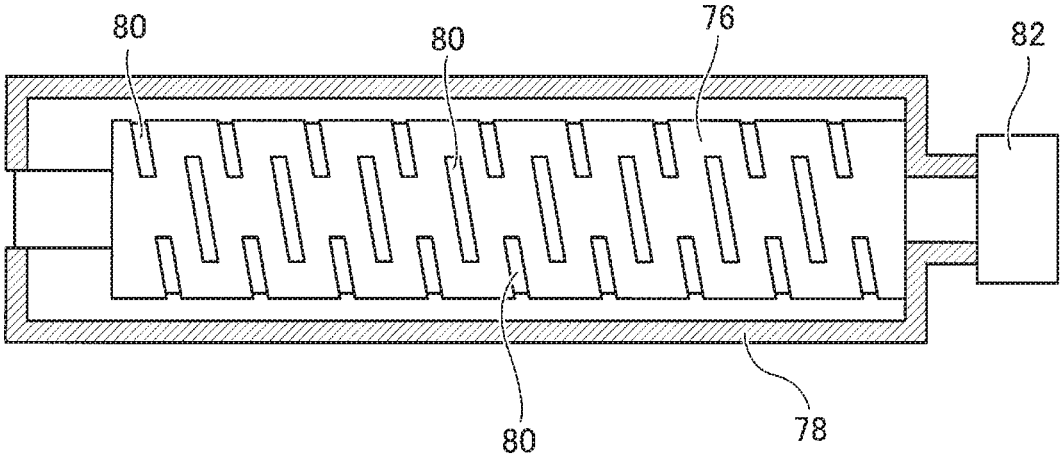
FIG. 4 is a cross-sectional view showing the developer container used in the developer supply device according to the exemplary embodiment of the present disclosure.

As shown in FIGS. 3 and 4, the developer supply device 74 includes the developer container 76. The developer container 76 is a container that contains a developer (including a toner and a carrier; but may not include carrier). The developer container 76 formed in a cylindrical shape, for example. The developer container 76 is of a self-rotating type and is rotatably supported by a support portion 78. Plural developer guiding portions 80 protruding inward are formed on the side surface of the developer container 76. The developer guiding portions 80 are separated from each other, each elongates obliquely with respect to a rotation direction of the developer container 76, and are formed in a spiral shape.

A driving device 82 is connected to one end of the developer container 76. The driving device 82 is, for example, a stepping motor, and constitutes an adjustment mechanism that adjusts a rotation angle of the developer container 76 as will be described later. Further, a container side discharge port 84 is formed at the other end of the developer container 76. When the developer container 76 is rotated by the driving device 82, the developer in the developer container 76 is guided toward the container side discharge port 84 by the developer guiding portion 80, and is discharged through the container side discharge port 84 toward a supply device main body 86 which will be described later.

Figure 5:
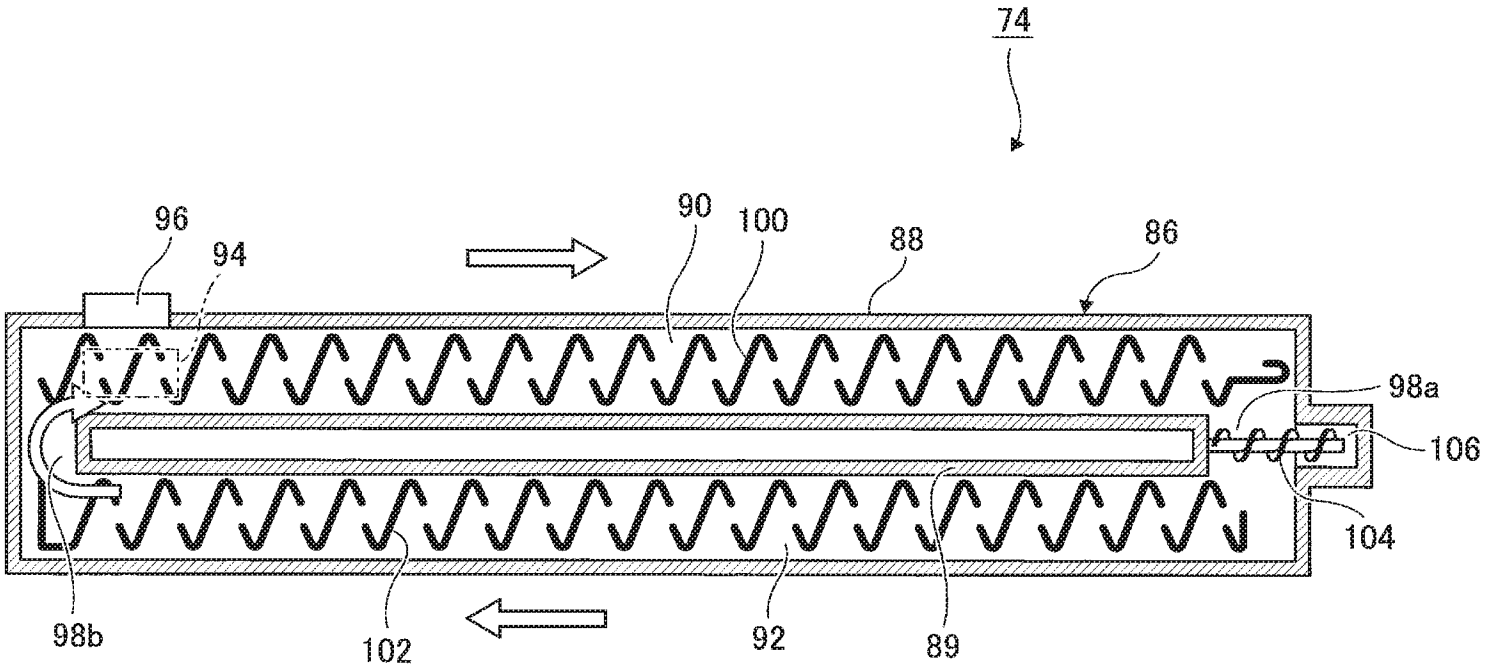
FIG. 5 is a cross-sectional view showing a developer supply device main body used in the developer supply device according to the exemplary embodiment of the present disclosure.

As shown in FIG. 5, the developer supply device 74 includes the supply device main body 86. The supply device main body 86 has a rectangular frame body 88. A first transport path 90 and a second transport path 92 are formed in the frame body 88 along the longitudinal direction of the supply device main body 86 and partitioned by a partition portion 89. For example, a supply port 94 is formed at the left end in the drawing of the first transport path 90. The supply port 94 is connected to the container side discharge port 84 of the developer container 76 described above. The developer is supplied from the developer container 76 via the supply port 94.

A developer sensor 96 is provided in the vicinity of the supply port 94. The developer sensor 96 is of, for example, a pressure-sensitive type. If there is a developer in the first transport path 90, the developer sensor 96 detects the presence of the developer based on pressure applied from the developer.

The first transport path 90 and the second transport path 92 are connected by connection portions 98*a* and 98*b* on both sides in the longitudinal direction of the frame body 88. The developer circulates between the first transport path 90 and the second transport path 92 via the connection portions 98*a* and 98*b*.

A first transport member 100 is disposed in the first transport path 90. The first transport member 100 is formed in a coil shape, for example. A second transport member 102 is disposed in the second transport path 92. The second transport member 102 is formed in a coil shape similarly to the first transport member 100. A third transport member 104 is disposed in the connection portion 98*a* (that is, one of the connection portions 98*a* and 98*b*). The third transport member 104 is formed in a spiral shape, for example. A main body side discharge port 106 is formed in the frame body 88 near the front end of the third transport member 104. The main body side discharge port 106 is connected to the developer transport unit 52 of the developing device 30. The developer is supplied to the developing device 30 via the main body side discharge port 106.

Figure 6:
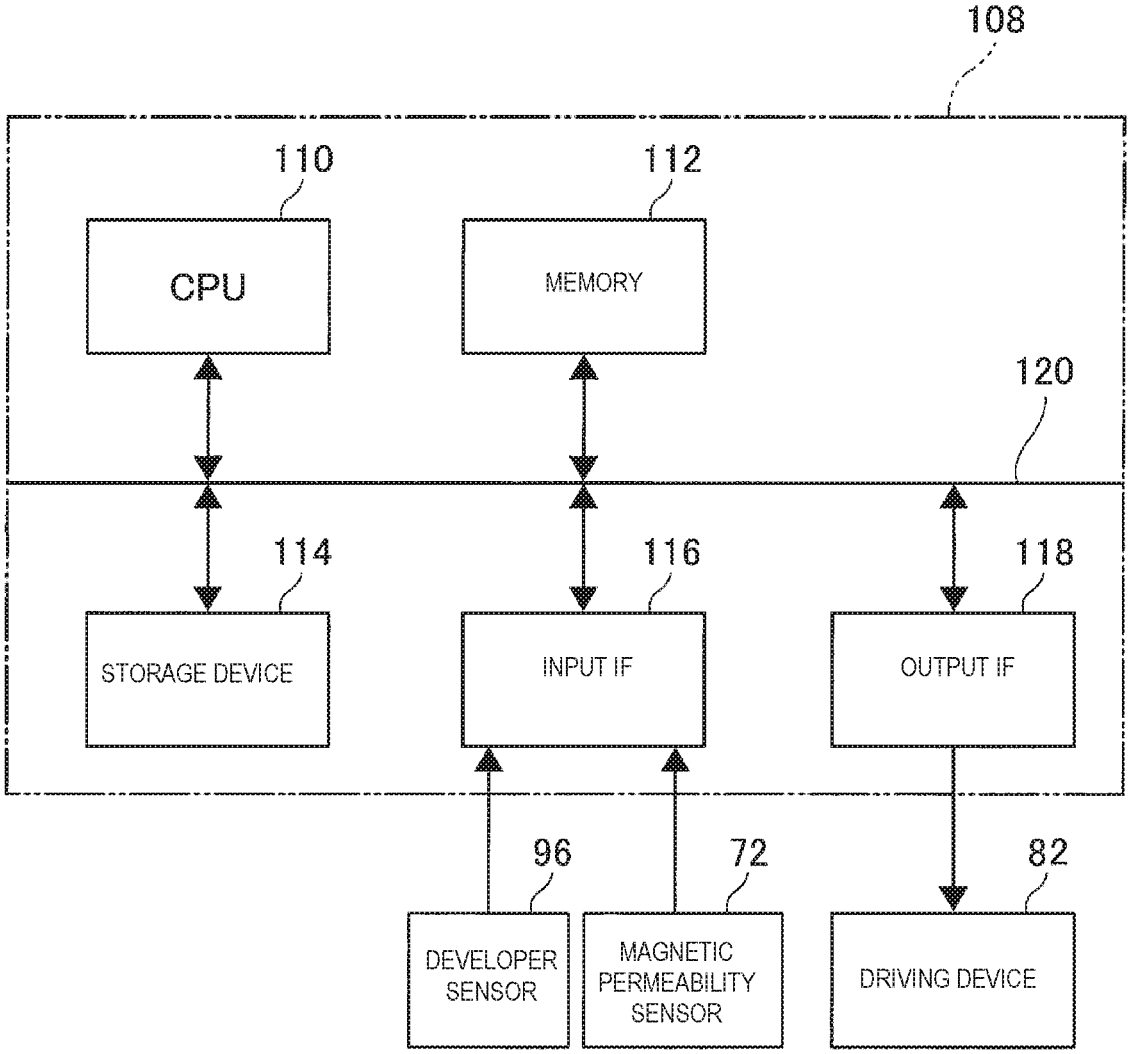
FIG. 6 is a block diagram showing a controller of the image forming apparatus according to the exemplary embodiment of the present disclosure.

FIG. 6 shows a controller 108 of the image forming apparatus 10 for controlling the driving device 82 that drives the developer container 76.

The controller 108 includes a CPU 110, a memory 112, a storage device 114, an input interface 116, and an output interface 118. The CPU 110, the memory 112, the storage device 114, the input interface 116, and the output interface 118 are connected to each other via a bus 120.

The CPU 110 executes predetermined processing based on a control program stored in the memory 112. The storage device 114 includes, for example, a hard disk, and stores necessary software and data. Data detected by the magnetic permeability sensor 72 and the developer sensor 96 are input to the input interface 116. The driving device 82 is connected to the output interface 118. The driving device 82 is controlled via the output interface 118.

Figure 7:
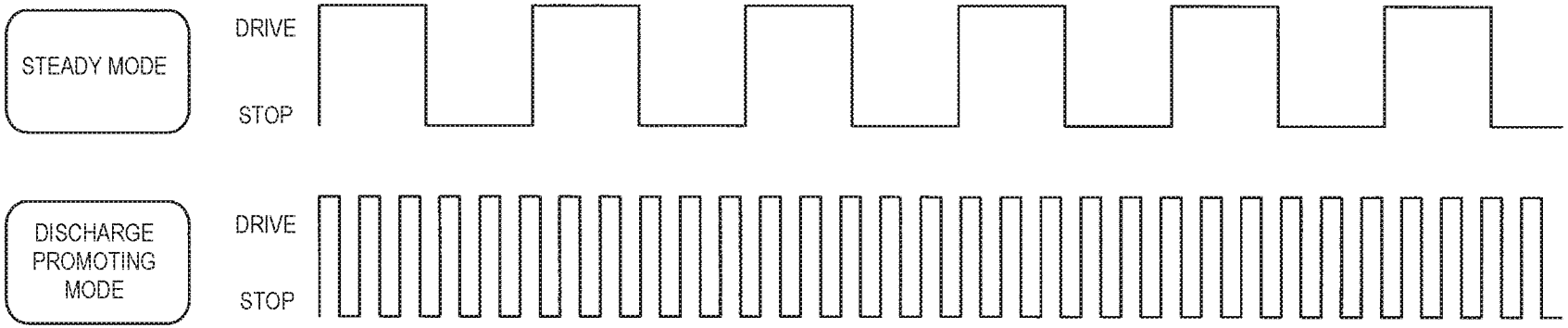
FIG. 7 is a waveform diagram showing driving states when the developer container is driven in a steady mode and when the container is driven in a discharge promoting mode, in the developer supply device according to the exemplary embodiment of the present disclosure.

For example, as shown in FIG. 7, the driving device 82 is controlled to be driven in a steady mode (also referred to as a "first mode") and a discharge promoting mode (also referred to as a "second mode"). The steady mode is a mode in which the period of driving and stopping is long, and the discharge promoting mode is a mode in which the period of driving and stopping is shorter than that in the steady mode. The steady mode and the discharge promoting mode are identical in a driving time per unit time and a stopping time per unit, and different in a rotation angle of the developer container 76 per driving. The rotation angle in the discharge promoting mode is smaller than that in the steady mode. In other words, the controller 108 drives the driving device 82 at a higher frequency in the discharge promoting mode than in the steady mode.

Next, a difference in behavior between the steady mode and the discharge promoting mode will be described with reference to FIGS. 8 and 9.

Figure 8:
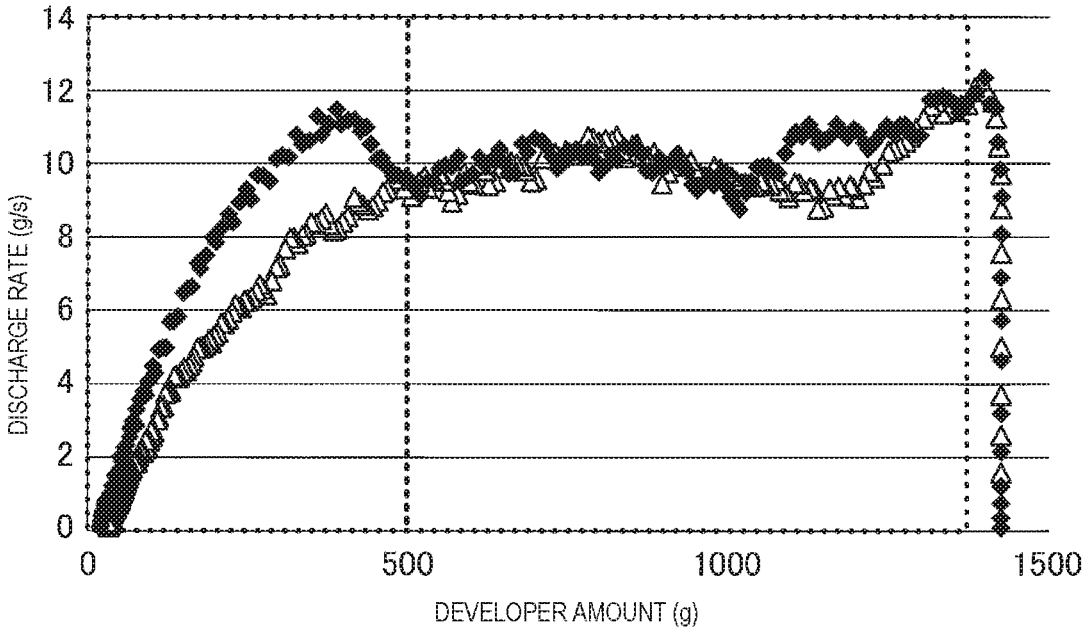
FIG. 8 is a characteristic curve diagram showing characteristics when the developer container is driven in the steady mode and when the developer container is driven in the discharge promoting mode, in the developer supply device according to the exemplary embodiment of the present disclosure.
Figure 9:
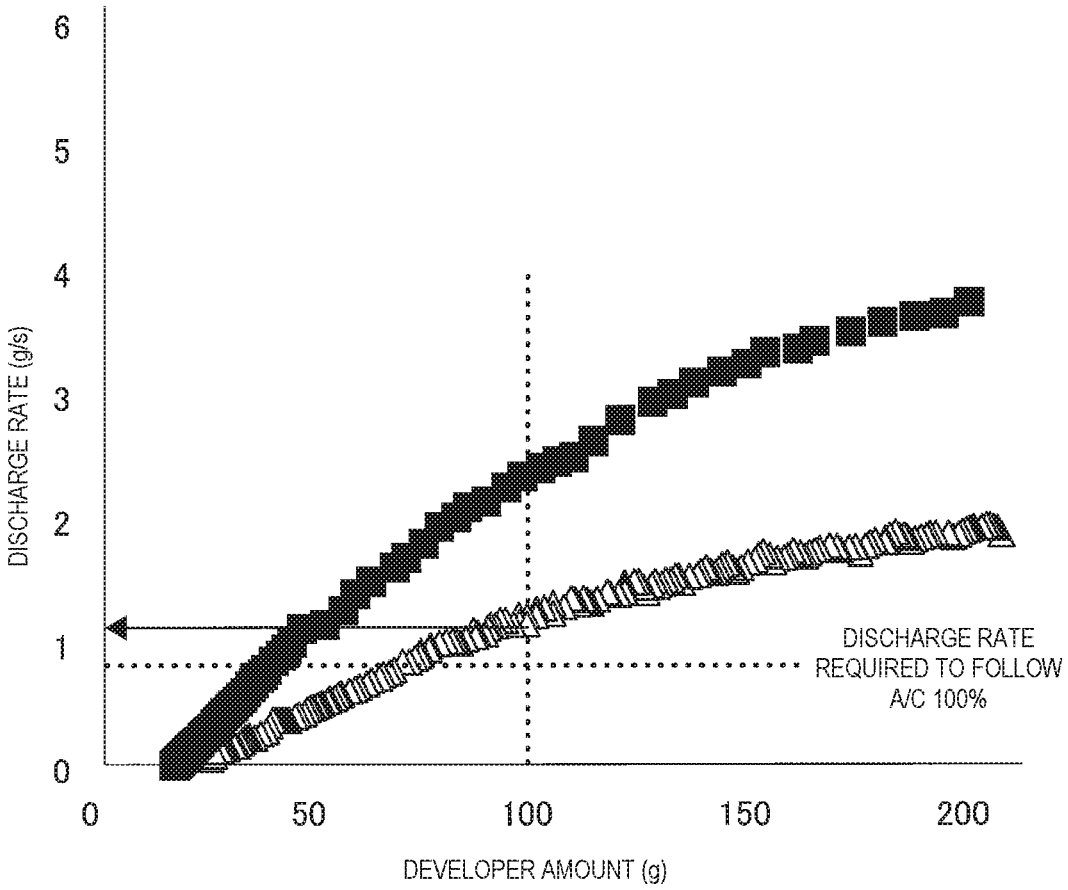
FIG. 9 is an enlarged characteristic curve diagram showing enlarged characteristics of a portion with a small developer remaining amount when the developer container is driven in the steady mode and when the developer container is driven in the discharge promoting mode, in the developer supply device according to the exemplary embodiment of the present disclosure.

In FIGS. 8 and 9, the horizontal axis represents a developer amount (grams) in the developer container 76, and the vertical axis represents a discharge rate (discharge amount per unit time, here expressed in grams/second) of the developer discharged from the developer container 76. When the developer container 76 starts to be used, for example, 1,500 grams of the developer remain. In either the steady mode or the discharge promoting mode, the developer remaining amount in the developer container 76 decreases as printing is executed by the image forming apparatus 10.

From the beginning of the use of the developer container 76, for example, until the developer remaining amount reaches 500 grams, the discharge rates in the steady mode and the discharge promoting mode are substantially the same. However, for example, when the developer remaining amount is 500 grams or less, the discharge rate gradually decreases in the steady mode, while in the discharge promoting mode, the discharge rate is once increased, and then the discharge rate is higher than that in the steady mode.

When the developer remaining amount in the developer container 76 decreases, in the steady mode, the developer adheres to the wall surface or the like of the developer container 76 and a ratio of the developer remaining in the developer container 76 increases. On the other hand, in the discharge promoting mode, the ratio of the developer adhering to the wall surface of the developer container 76 is reduced by quickly rotating the developer container 76 by a smaller rotation angle and increasing the number of driving and stopping operations.

In the discharge promoting mode, since the amount of developer discharged per drive is small, variation in the discharge rate is large and the discharge rate is unstable. On the other hand, in the steady mode, since the amount of developer discharged per drive is large, a stable discharge rate is maintained.

Therefore, the developer container 76 is rotated in the steady mode from the beginning of use until a predetermined developer remaining amount in the developer container is reached, and when the developer remaining amount in the developer container 76 is less than a predetermined range, the steady mode is switched to the discharge promoting mode.

As shown in FIG. 9, for example, when it is attempted to ensure a discharge rate at which an image of 1×00% density can be formed on the entire recording medium, the steady mode needs, for example about 100 grams of the developer remaining amount in the developer container 76, while the discharge promoting mode can deal with this situation until the developer remaining amount reaches 50 grams. Therefore, the steady mode is switched to the discharge promoting mode until the developer remaining amount in the developer container 76 changes from 100 grams to 50 grams.

A more specific example will be described.

Figure 10:
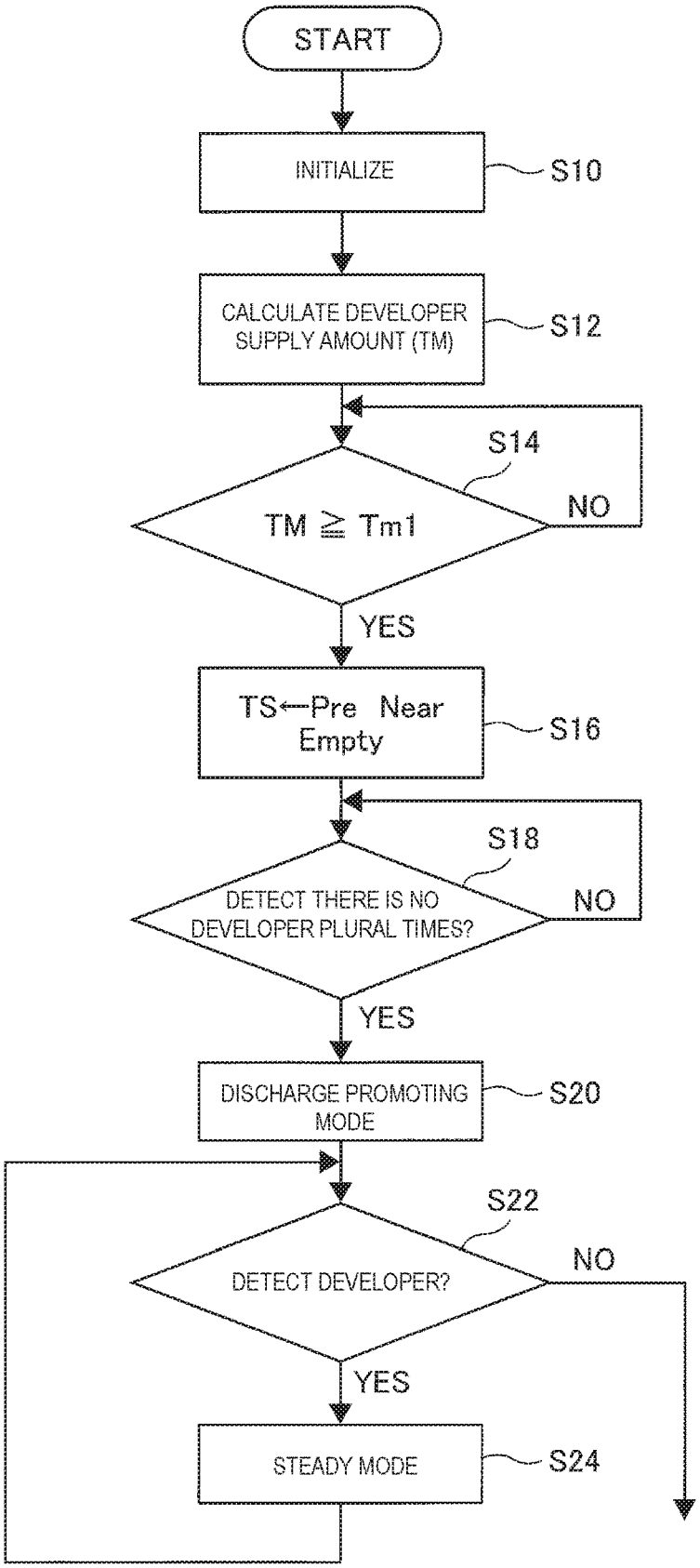
FIG. 10 is a flowchart of an example of control from the start of use to pre near empty in the image forming apparatus according to the exemplary embodiment of the present disclosure.

FIG. 10 is a flowchart showing an example of a control flow from the beginning of use of the developer container 76 until the developer container 76 becomes pre near empty. It is assumed that the developer remaining amount in the developer container 76 has any of three statuses including pre near empty, near empty, and empty. The pre near empty is the first stage, and is a state in which an estimated developer remaining amount in the developer container 76 is smaller than a predetermined value. Here, the estimated developer remaining amount in the developer container 76 is determined based on the driving time of the driving device 82.

First, in step S10, the developer remaining amount, status, mode, and the like are initialized. When the developer container 76 starts to be used, the developer remaining amount is set to 100% and the mode is set to the steady mode.

In the next step S12, a developer supply amount (TM) is calculated. A value obtained by integrating the driving time each time the driving device 82 is driven is stored in the storage device 116 as the developer supply amount (TM).

In the next step S14, it is determined whether or not the developer supply amount (TM) is greater than a predetermined value (Tm1) (that is, whether or not the developer remaining amount in the developer container 76 is smaller than a predetermined value). The driving device 82 is driven in the steady mode set at an initial setting until the predetermined value (Tm1) is reached.

In step S14, when it is determined that the developer supply amount (TM) is greater than the predetermined value (Tm1), the processing moves to step S16, and the status is set to the pre near empty. The predetermined value (Tm1) may be, for example, a value based on which the developer remaining amount is estimated to be in a range of about 10% to about 15%.

In the next step S18, it is determined whether or not the developer sensor 96 detects there is no developer plural times. The processing at step S18 is repeated until the developer sensor 96 detects that there is no developer plural times, so that the steady mode is continued. On the other hand, when the developer sensor 96 detects that there is no developer plural times, the processing proceeds to step S20 to switch to the discharge promoting mode.

In the next step S22, it is determined whether or not the developer sensor 96 detects the developer immediately after the switching to the discharge promoting mode. When it is determined that the developer sensor 96 detects the developer, the processing proceeds to step S24 to return to the steady mode. On the other hand, when it is determined that the developer sensor 96 does not detect the developer, the discharge promoting mode is continued.

Figure 11:
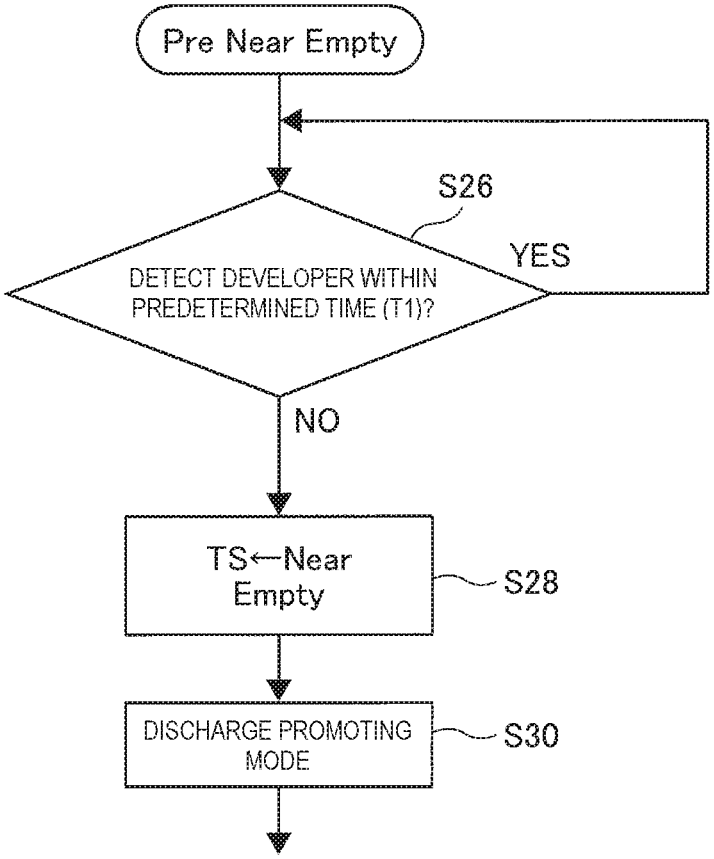
FIG. 11 is a flowchart of an example of control from the pre near empty to near empty in the image forming apparatus according to the exemplary embodiment of the present disclosure.

FIG. 11 is a flowchart showing an example of a control flow from the pre near empty to the near empty of the developer container 76. In the present example, it is assumed that the steady mode is continued until the near empty is reached.

In step S26, it is determined whether or not the developer sensor 96 detects the developer within a predetermined time (T1, for example, 50 seconds) after the driving device 82 is driven. The steady mode is continued until the developer sensor 96 does not detect the developer within the predetermined time (T1).

When it is determined in step S26 that the developer sensor 96 does not detect the developer within the predetermined time (T1), the processing proceeds to step S28 in which the status is set to the near empty. Then, in step S30, the mode is switched from the steady mode to the discharge promoting mode. A rough standard of the near empty is, for example, such that the developer remaining amount is estimated to be in a range of about 5% to about 10%.

Figure 12:
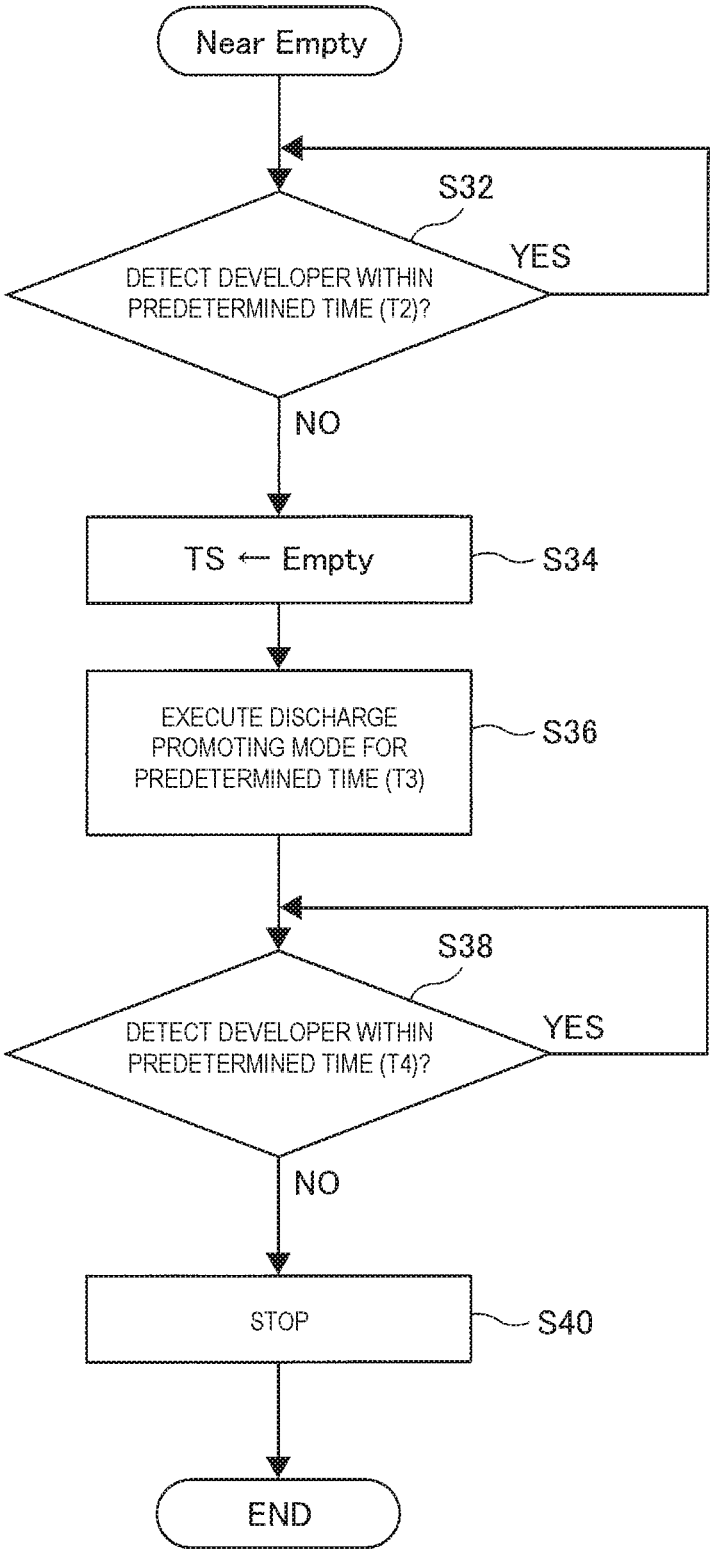
FIG. 12 is a flowchart of an example of control from the near empty to empty in the image forming apparatus according to the exemplary embodiment of the present disclosure.

FIG. 12 is a flowchart showing an example of a control flow from the near empty of the developer container 76 to the empty of the developer container 76. In the present example, it is assumed that the steady mode is continued until the empty is reached.

In step S32, it is determined whether or not the developer sensor 96 detects the developer within a predetermined time (T2, for example, 100 seconds) after the driving device 82 is driven. The steady mode is continued until the developer sensor 96 does not detect the developer within the predetermined time (T2).

When it is determined in step S32 that the developer sensor 96 does not detect the developer within the predetermined time (T2), the processing proceeds to step S34 in which the status is set to the empty, but in the next step S36, the mode is switched to the discharge promoting mode for a predetermined time (T3).

In the next step S38, it is determined whether or not the developer sensor 96 detects the developer within a predetermined time (T4) after the driving device 82 is driven. Use permission of the image forming apparatus is continued in the discharge promoting mode until the developer sensor 96 does not detect the developer within the predetermined time (T4). When the developer sensor 96 does not detect the developer within the predetermined time (T4), the processing proceeds to step S40 to stop the image forming apparatus.

In the above exemplary embodiment, the rotation of the developer container 76 is controlled in two stages including the first mode and the second mode. It should be noted that the present disclosure is not limited thereto. Alternatively, the rotation of the developer container 76 may be controlled in three or more stages or may be controlled without stages.

In the above exemplary embodiment, the developer supply device main body 86 is provided between the developer container 76 and the developing device 30. It should be noted that the present disclosure is not limited thereto. Alternatively, the developer supply device main body 86 may not be provided, and the developer may be directly supplied from the developer container 76 to the developing device 30.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer supply device comprising:

a developer container configured to supply developer by rotating;

an adjustment mechanism configured to adjust a rotation angle of the developer container; and a controller configured to control the rotation angle of the developer container by the adjustment mechanism according to a developer remaining amount in the developer container, wherein the controller controls the developer container to rotate at a same speed after adjusting the rotation angle as before adjusting the rotation angle.

2. The developer supply device according to claim 1, wherein the adjustment mechanism includes a first mode in which the rotation angle of the developer container is determined in advance, and a second mode in which the rotation angle is smaller than the rotation angle in the first mode.

3. The developer supply device according to claim 2, wherein the controller chooses the first mode until the developer remaining amount in the developer container is estimated to be a predetermined value, and when the developer remaining amount in the developer container is estimated to be equal to or less than the predetermined value, the controller performs control so as to switch from the first mode to the second mode.

4. The developer supply device according to claim 3, further comprising:

a developer sensor configured to detect that the developer is supplied from the developer container, wherein when the developer remaining amount in the developer container is estimated to be equal to or less than the predetermined value, the controller performs control so as to choose the first mode until the developer sensor detects that there is no developer.

5. The developer supply device according to claim 4, wherein when the developer remaining amount in the developer container is estimated to be equal to or less than the predetermined value, the controller performs control so as to choose the first mode until the developer sensor detects that there is no developer plural times.

6. The developer supply device according to claim 3, further comprising:

a developer sensor configured to detect that the developer is supplied from the developer container, wherein when (i) the developer remaining amount in the developer container is estimated to be equal to or less than the predetermined value and (ii) the developer sensor detects that there is the developer, the controller performs control so as to return from the second mode to the first mode.

7. The developer supply device according to claim 1, wherein the developer container is rotated by a stepping motor, and the rotation angle is adjusted by changing a duration of an on time of the stepping motor.

8. The developer supply device according to claim 7, wherein a frequency between on times and off times of the stepper motor is increased when the rotation angle is decreased.

9. An image forming apparatus comprising:

a developing device configured to develop a latent image formed on an image carrier; and a developer supply device configured to supply developer to the developing device, wherein the developer supply device comprises a developer container configured to supply the developer by rotating, an adjustment mechanism configured to adjust a rotation angle of the developer container, and a controller configured to control the rotation angle of the developer container by the adjustment mechanism according to a developer remaining amount in the developer container, wherein the controller controls the developer container to rotate at a same speed after adjusting the rotation angle as before adjusting the rotation angle.

10. The image forming apparatus according to claim 9, further comprising:

a developer sensor configured to detect that the developer is supplied from the developer container, wherein the adjustment mechanism includes a first mode in which the rotation angle of the developer container is determined in advance, and a second mode in which the rotation angle is smaller than the first mode, when the developer remaining amount in the developer container is estimated to be equal to or less than a predetermined value, the controller performs control so as to switch from the first mode to the second mode, and when the developer sensor detects that there is no developer, the controller stops driving of the image forming apparatus.

11. The image forming apparatus according to claim 10, wherein when the developer sensor detects that there is the developer, the driving of the image forming apparatus is continued.

12. The image forming apparatus according to claim 9, wherein the developer container is rotated by a stepping motor, and the rotation angle is adjusted by changing a duration of an on time of the stepping motor.

13. The image forming apparatus according to claim 12, wherein a frequency between on times and off times of the stepper motor is increased when the rotation angle is decreased.

14. A developer supply device comprising:

developer containing means for supplying developer by rotating;

adjusting means for adjusting a rotation angle of the developer containing means; and means for controlling the rotation angle of the developer containing means by the adjusting means according to a developer remaining amount in the developer containing means, wherein the controlling means controls the developer container to rotate at a same speed after adjusting the rotation angle as before adjusting the rotation angle.

15. The developer supply device according to claim 14, wherein the developer containing means is rotated by a stepping motor, and the rotation angle is adjusted by changing a duration of an on time of the stepping motor.

16. The developer supply device according to claim 15, wherein a frequency between on times and off times of the stepper motor is increased when the rotation angle is decreased.

* * * * *